United States Patent [19]

Romine

[11] Patent Number: 4,697,389

[45] Date of Patent: Oct. 6, 1987

[54] DUST-CONFINING VACUUM SANDER

[76] Inventor: Richard A. Romine, 13251 Cherry St., Westminster, Calif. 92683

[21] Appl. No.: 862,661

[22] Filed: May 13, 1986

[51] Int. Cl.[4] ..... B24B 23/00; B24B 55/10

[52] U.S. Cl. ..... 51/180; 51/273

[58] Field of Search ..... 51/273, 180, 390, 170 R; 15/393, 398, 399, 400

[56] References Cited

U.S. PATENT DOCUMENTS

| | | | |
|---|---|---|---|
| 1,067,280 | 7/1913 | Smilovetz | 51/390 |
| 1,582,664 | 4/1926 | Bennington | 51/180 |
| 1,728,487 | 9/1929 | Gardner | 51/180 |
| 1,919,854 | 7/1933 | Masseau | 51/180 |
| 1,927,186 | 9/1933 | Raaen | 51/180 |
| 2,711,059 | 6/1955 | Ames | 51/390 |
| 2,753,669 | 7/1956 | Larson | 51/180 |
| 3,646,712 | 3/1972 | Quintana | 51/273 |
| 3,815,292 | 6/1974 | Hutchins | 51/273 |
| 3,826,045 | 7/1974 | Champayne | 51/273 |
| 4,062,152 | 12/1977 | Mehrer | 51/273 |

*Primary Examiner*—Roscoe V. Parker

*Attorney, Agent, or Firm*—Albert O. Cota

[57] ABSTRACT

A dust confining vacuum sander (10) that is primarily designed to be placed on an extension tube to sand ceilings and upper wall surfaces. Without the extension tube, the sander may also be used to sand other lower level and horizontal surfaces. The sander (10) is comprised of a dust-confining shroud (18) having a peripheral opening (18*a*) into which is captively retained a sanding pad (12) that extends above the opening. The bottom surface of the shroud includes a vacuum port (18*b*) that is connected to a vacuum unit (90) by way of a vacuum tube (26). When the sander is operated, the loosened dust enters the shroud and is sucked through the vacuum tube (26) into the vacuum unit (90). Thus, protecting the operator from the abraded dust and reducing the amount of dust in the work area.

13 Claims, 13 Drawing Figures

Fig.1.
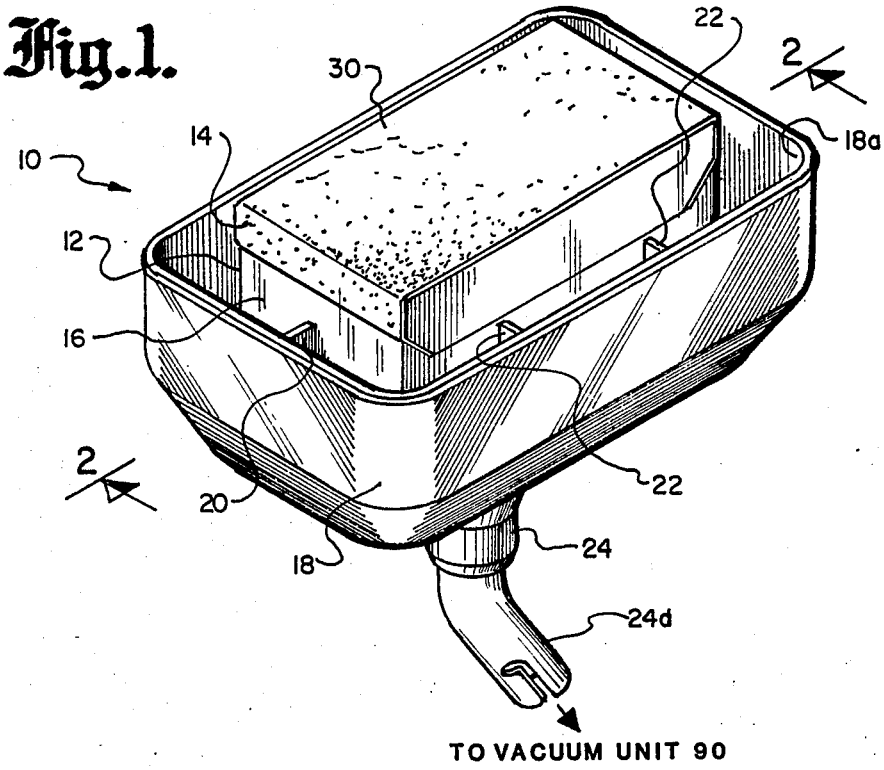
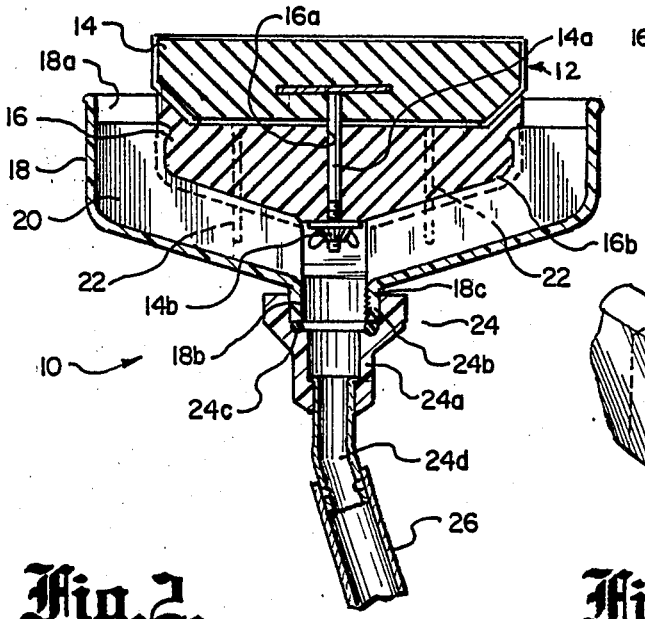
Fig.2.
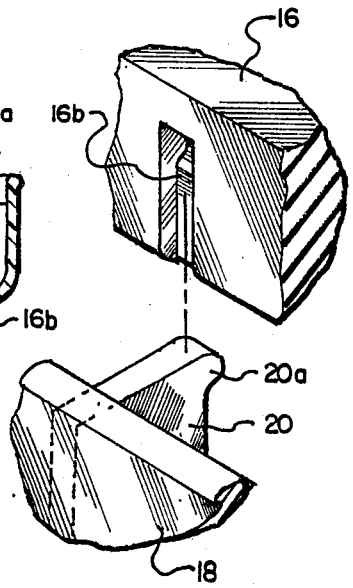
Fig.3.

Fig.9.
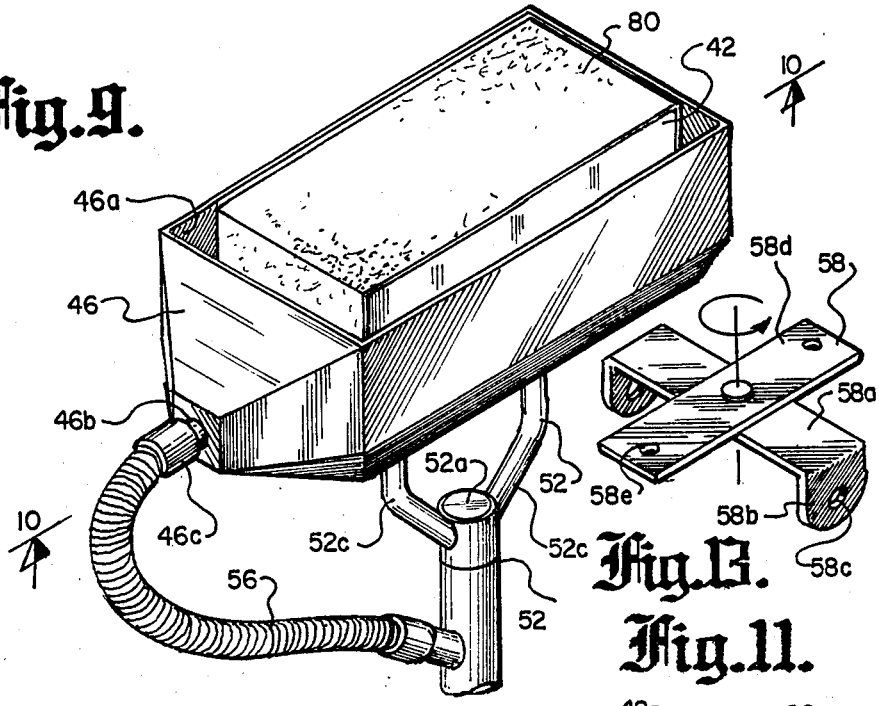
Fig.13.
Fig.11.
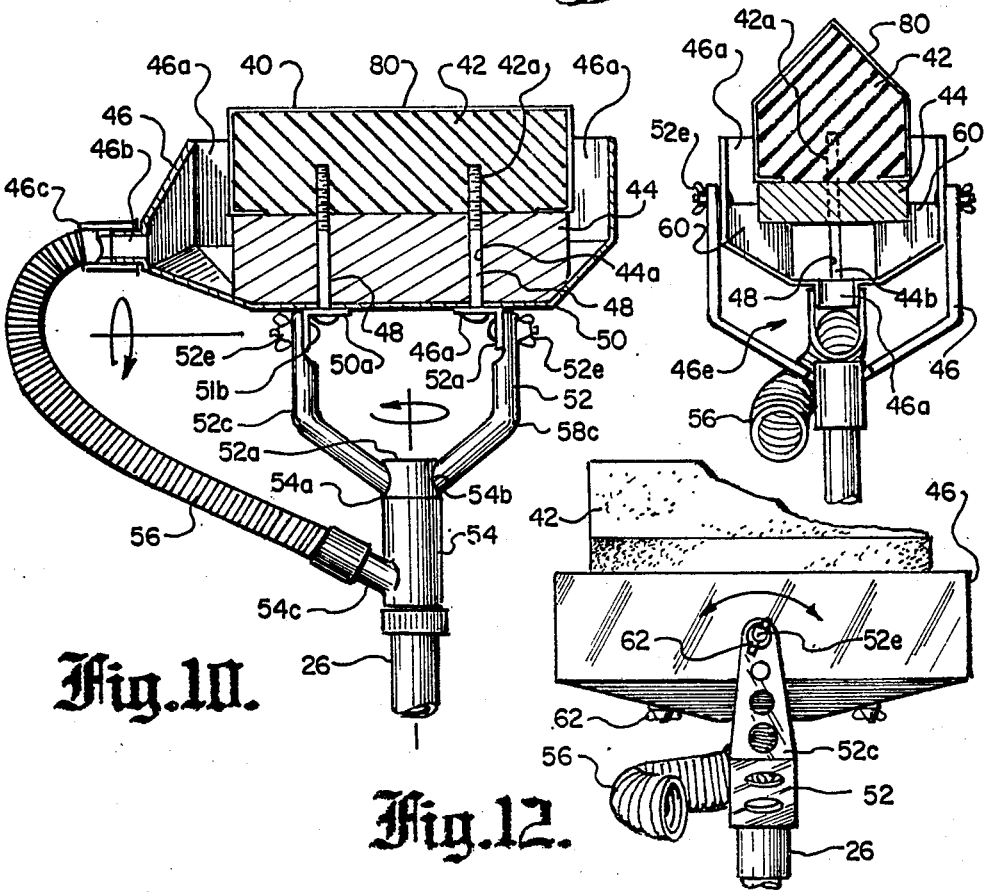
Fig.10.
Fig.12.

DUST-CONFINING VACUUM SANDER

TECHNICAL FIELD

The invention pertains to the general field of manually operated sanding devices and more particularly to a vacuum sander for abrasively removing material from a surface and collecting the removed residue through a shroud connected to a vacuum unit by means of a vacuum tube.

BACKGROUND ART

In the field of carpentry, plastering and drywall construction a smooth finish is generally produced by sanding the surface. In drywall construction, for example, the abutting edges of the plasterboard sheets are covered with a paper or fabric tape and the sheets are coated with a layer of plaster. After the plaster has dried, it is sanded until a sufficient quantity of plaster is removed so that all the sheets have a continuous smooth surface. The application of the drywall is generally performed near the end of the construction project. Therefore, it is important that the fine plaster dust removed by the sander be collected and confined so that the dust does not enter the embient air and interfere with such subsequent construction stages as painting, counter work and wall papering. During remodeling and repair, it is especially important to collect and confine the dust to a small area.

There are currently available several sanding devices and particularly electrical motor driven sanders that employ a vacuum chamber for collecting and depositing the dust in a collector chamber.

For the most part these vacuum sanders are too large and heavy to allow extended periods of operation, and they are not designed to be mounted on the end of an extended vacuum tube or rod. A sander mounted on such a vacuum tube or rod is especially useful for sanding upper wall sections and the ceiling.

A search of the prior art did not disclose any patents that read on the claims of the instant invention. However, the following U.S. patents are considered related and indicative of the state of the art.

| U.S. Pat. No. | INVENTOR | ISSUED |
|---|---|---|
| 4,062,152 | Meher | 13 December 1977 |
| 3,826,045 | Champayne | 30 July 1974 |
| 3,815,292 | Hutchins | 11 June 1974 |
| 3,646,712 | Quintana | 7 March 1972 |

The Meher patent discloses a vacuum sander that includes an abrasive sheet mounted on the front surface of a backing plate. A manifold covers the rear surface of the backing plate, and the interior of the manifold communicates with the abrasive sheet through a plurality of bores in the plate. The manifold is maintained at reduced pressure by a partial vacuum communicating with the manifold through a tubular handle connected to the vacuum source. The residue produced by using the sander is collected by the vacuum in the manifold and conveyed to the vacuum source through the handle.

The Champayne patent discloses a vacuum unit for removing abraded dust through a suction line communicating with a dust confining shroud. The shroud overlies and extends around the abrading pad of the machine, and is connected to a suction line manifold. The manifold, in turn, is connected to a flexible hose that leads to a vacuum source.

The Hutchins patent discloses an abrading tool having an aspirator for creating a partial vacuum that acts to withdraw abraded particles to a collector. The aspirator includes a conduit forming a passage into which air and entrained particles are drawn. The air is drawn through an opening, with air inlet means that directs a flow of air into the passage and across the opening to induce the desired movement of the particles.

The Quintana patent discloses a dust-removing attachment device for rotary disk power grinders or sanders. The device maintains a continuous current of air over and around the grinding/sanding surface to capture and withdraw dust particles into a vacuum chamber. The exhaust air from a vacuum cleaner tank is directed through a first plenum to discharge forcefully about the rotary disk at one side. A vacuum plenum open at the other side of the disk and leading to the input of the vacuum cleaner maintains a strong current of dust-capturing circulating air.

DISCLOSURE OF THE INVENTION

The dust-confining vacuum sander is a manually operated tool that is primarily designed to be placed on an extension tube to sand ceilings and upper wall sections. However, without the extension tube, the sander can still be used to sand other lower level and horizontal surfaces. In either case, because of its light weight, the sander can be manipulated with very little effort to accomplish the sanding task.

The sander is comprised of a sanding pad that uses readily available sanding paper. The pad is contained within a dust confining shroud that is connected to a vacuum unit, such as a houseld vacuum cleaner, by means of an extension tube or a flexible hose. The vacuum connection allows the abraded dust loosened by the sander to be sucked into the shroud and delivered to the vacuum unit by way of the extension tube. The loosened dust is particularly annoying and potentially harmful when sanding the ceiling where gravity and ambient air disperses the dust downwardly over the operator and around a large section of the work area.

One of the problems inherent in the prior art sanders disclosed in the referenced patents is the weight of the units. Because of this weight, the sander is precluded from being placed on the end of an extension tube to allow upper work surfaces to be reached and sanded. Other problems in the prior art lies in the relative higher complexity of these sanders.

Therefore, it is the primary object of the invention to provide a simple vacuum-aided sander that can be used with a household vacuum cleaner to facilitate the sanding operation while reducing the amount of abraded dust in the work area.

Another object is to provide a vacuum-aided sander that can be used to sand ceilings and upper wall surfaces as well as other more readily accessible surfaces.

In addition to the above objects, it is also an object of the invention to provide a sander that is:

cost effective in terms of ownership, and/or manufacturing, reliable and easily maintained, and flexible and adaptable to various surfaces.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 1 is a perspective view of the preferred embodiment of the dust confining vacuum sander.

FIG. 2 is a cross-sectional view taken along lines 2—2 of FIG. 1.

FIG. 3 is a partial perspective view of the method used in the preferred embodiment to attach the lower section of the sanding pad to the pad clamping support.

FIG. 9 is a perspective view of the third embodiment of the dust confining vacuum sander.

FIG. 10 is a cross-sectional view taken along lines 10—10 of 1.

FIG. 11 is cross-sectional view of the second design of the third embodiment.

FIG. 12 is a side view of the second design of the third embodiment.

FIG. 13 is a cross-member bracket view of the third embodiment.

BEST MODE FOR CARRYING OUT THE INVENTION

Figure 4:
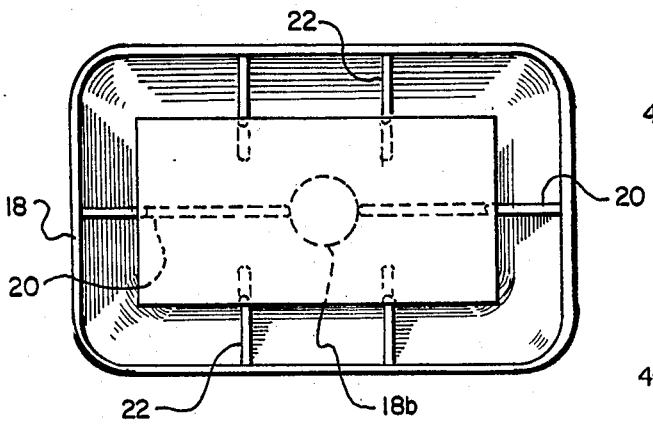
FIG. 4 is a top view of the preferred embodiment.

The best mode for carrying out the invention is presented in terms of a preferred, second and third embodiment. All three embodiments of the dust-confining vacuum sander 10, are primarily designed to protect the operator of the sander 10 from abrading dust and to reduce the amount of dust in the work area.

The preferred embodiment, as shown in FIGS. 1 through 4 is comprised of the following six major elements: a sanding pad 12; a dust-confining shroud 18, a hermetic connector 24, a vacuum tube 26, a strip of abrasive paper 80 and a vacuum unit 90.

The sanding pad 12 is designed with a means to retain on its upper side a strip of abrasive paper such as sandpaper 80. In the preferred embodiment, the sanding pad 12 as shown in FIGS. 1, 2 and 4, which may be constructed of a resilient material, such as hard rubber, or a hard material such as metal, plastic or wood, is comprised of an upper section 14 and a lower section 16. The upper section is preferably constructed of a resilient material and may be configured with a work contacting upper surface that is flat as shown in FIG. 1, an angular surface as shown in FIG. 11 or other shapes commensurate with the surface configuration that is to be sanded. In either construction, the upper section 14 has embedded within its body, as shown in FIG. 2, a rigid threaded rod **14*a*** that extends out the bottom surface.

The lower section 16 has a top contour that conforms to the bottom contour of the upper section 14. The bottom section also has a rod bore **16*a* therethrough that is in concentric alignment with the threaded rod 14*a*. On each end and lower surface of the bottom section is cut a convex detent/pad support groove 16*b***.

To hold the sandpaper 80 in place, the sandpaper is placed over the upper side of the upper section with the ends of the sandpaper folded inwardly as best shown in FIG. 2. The rod **14*a* is then inserted into the rod bore 16*a* and the upper section with the sandpaper in place, is tightened against the lower section by means of a nut, such as a wingnut 14*b*, that is threaded into the rod 14*a* and tightened. The sanding pad is now ready for insertion into the dust-confining shroud 18**.

The dust-confining shroud 18, as shown in FIGS. 1, 2 and 4, is constructed of a plastic material such as acrylic, polycarbonate, or a polystyrene and is preferably transparent to enable the operator to see the peripheral edge of the sanding pad 12 during the sanding operation. The shroud has a peripheral opening **18*a* on its upper side and a vacuum port 18*b* on its lower surface. Contiguous with and extending outwardly from the vacuum port 18*b* is a threaded nozzle 18c**.

The peripheral dust collecting area around the surface of the sanding pad 12 should be optimized based on the size of the vacuum hose and available suction. As a rule of thumb for household vacuums, the collecting area should not exceed two times the cross sectional area of the hose. Drywall plaster dust was effectively collected with an area ratio of 1.8 to 1 using a 400 watt hosehold vacuum cleaner.

The shroud includes a supporting means for the sanding pad 12. In the preferred embodiment, the pad is supported by integral supports: a rigid pad clamping support 20 and a set of rigid pad side supports 22.

Extending inwardly from each end of the shroud 18 is the rigid pad clamping support 20. The inward side of these supports conform to the end shape of the sanding pad's lower section 16 and each support also has a convex detent **20*a* that is in alignment and sized to fit into the corresponding concave detent/pad support groove 16 on the sanding pad. The detent/pad support groove allows the sanding pad 16 to be set into and locked in placed within the shroud 18**.

Extending inwardly from each side of the shroud 18 is the set of rigid pad side supports 22. The inward side of these supports conform to the side shape of the lower section 16 to provide lateral support to the sanding pad 12.

When the sanding pad 12 is locked in place, within the combination of the pad clamping supports 20 and the pad side supports 22, the upper side of the pad extends above the edge of the peripheral opening **18*a*** and an air space is provided between the inside walls and bottom surface of the shroud. In the preferred embodiment, the pad extends approximately 0.25 inches (6.4 mm) above the edge of the shroud.

The hermetic connector 24, as best shown in FIG. 2, is comprised of a housing **24*a* having a set of internal threads 24*b* that allow the connector to be threaded into the threaded nozzle 18*c*. Hermeticity between the shroud 18 and the connector 24 is achieved by an O-ring 24*c* that is placed between the edge of the threaded nozzle and seat of the connector as shown in FIG. 2**.

Located within the lower section of the housing **24*a*, is a captive, rotatable/angled vacuum nozzle 24*d***. The nozzle has an outside diameter that allows a tight fit within the inside walls of the nozzle to retain hermeticity. However, there is sufficient surface slippage to permit the nozzle to be rotated through 360-degrees during operation.

The nozzle, in the preferred embodiment, is bend at an obtuse angle of approximately 150-degrees as measured from a vertical reference plane. This angular displacement allows the upper section of a wall to be easily and comfortably sanded.

The nozzle 24*d* on the above described hermetic connector 24 has a fixed angular displacement. However, there are several connector designs that include a universal-type joint that allows a nozzle to hermetically swivel through 360-degrees. Since this nozzle/connector design is well known in the art, it is not described or shown herein.

The final element presented is the vacuum tube 24. This tube is preferably constructed of metal to provide rigidity and has a diameter that allows the tube to be hermetically attached, on one end, to the rotatable/angled vacuum nozzle and on the other end to a vacuum unit 90. The vacuum unit in the preferred embodiment consists of a household vacuum cleaner that has a power rating on the order of 400 watts.

The sander 10 is primarily designed to be used with the vacuum tube 26 to permit an operator to sand the upper sections of a wall and/or the ceiling. However, a vacuum tube of shorter length may also be employed as well as no tube at all. When the sander is used without an extension tube, a vacuum attachment means, such as a flexible vacuum hose, similar to the vacuum hose shown in FIG. 10, is connected directly to the vacuum nozzle 24*d* on the connector 24. In this case, the operator grasps the shroud 18, with either one or two hands, to use the sander directly against a working surface.

Figure 6:
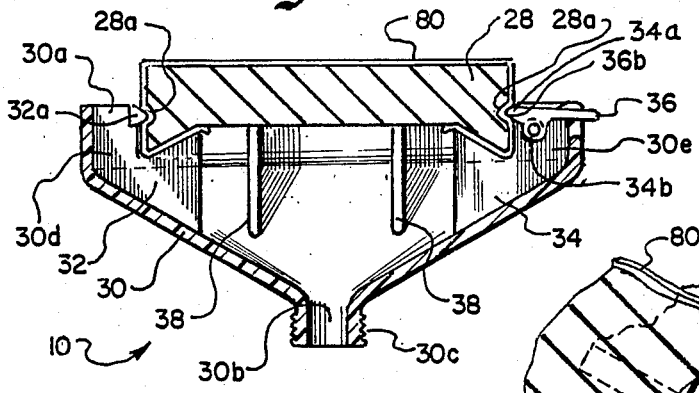
FIG. 6 is cross-sectional view of the second embodiment.
Figure 8:
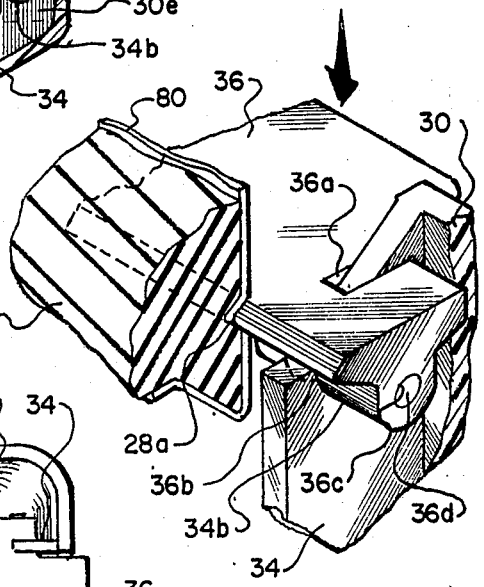
FIG. 8 is a partial perspective view of the method used in the second embodiment to attach the sanding pad to the U-shaped spring clip.
Figure 7:
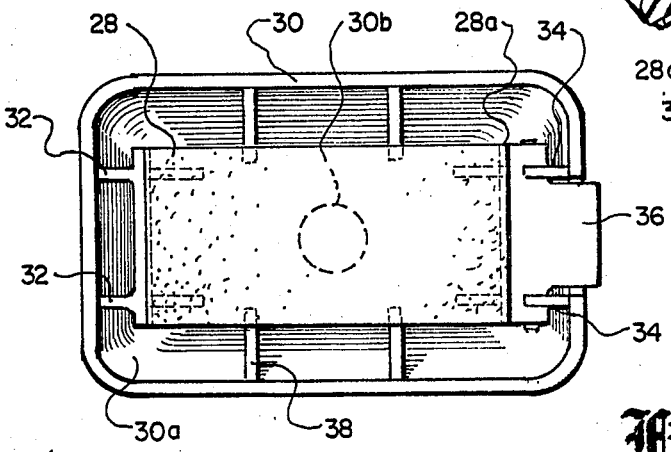
FIG. 7 is a top view of the second embodiment.

The second embodiment of the dust-confining vacuum sander 10 as shown in FIGS. 6 through 8 is comprised of the following six major elements: a sanding pad 28, a dust-confining shroud 30; a hermetic connector 24; a vacuum tube 26; a strip of sand paper 80 and a vacuum unit 90.

The sanding pad 28 in the second embodiment is constructed in one piece of either a resilient or hard material. The pad, as best shown in FIG. 6, has a flat upper surface and a lateral concave detent 28*a* on each end.

The dust-confining shroud 30, as shown in FIGS. 6 and 7, is constructed of an identical material as described for the first embodiment and is also preferably transparent. The shroud 30 has a peripheral opening 30*a* on its upper side and a vacuum port 30*b* on its lower surface. Contiguous with and extending outwardly from the vacuum port 30*b* is a threaded nozzle 30*c*.

The shroud 30 differs from the shroud in the preferred embodiment in the supporting means for the sanding pad 28. In the second embodiment, the pad is supported by a set of rigid first pad clamping supports 32, a set of rigid second pad clamping supports 34 and a set of pad side supports 38. All supports are integral with the shroud.

The first pad clamping supports 32 extend inwardly from the shroud first end 30*d* and conform to the end shape of the sanding pad 28. The upper ends of each support has a convex detent 32*a* that is in alignment and sized to fit into the corresponding lateral concave detent 28*a* on the pad 28.

The second pad clamping supports 34 extend inwardly from the shroud second end 30*e* and conform to the respective end shape of the pad 28. Each support 34 has near its top edge, as shown in FIG. 6, a rod bore 34*b* extending laterally therethrough and a convex detent 34*a* that is in alignment and sized to fit into the corresponding lateral concave detent 28*a* on the pad 28.

The second pad clamping supports 34 are designed to accept a V-shaped spring clip 36 that serves as the primary means to retain the abrasive paper 80 surrounding the upper surface of the sanding pad 28. The clip has a slot 36*a* on each inward end, as best shown in FIG. 8, that is configured to allow the clip to move vertically along the respective edges of the supports 34. The inward lateral edge 36*b* of the clip is shaped to fit into the lateral concave detent 28*a* on the sanding pad 28 when the clip is in its neutral-holdin9 position. That is, the position that releases the abrasive paper on the sanding pad.

The clip further has a lateral rod bore 36*c* on each end into which is inserted a spring-biased pivot rod 36*d*. The inward ends of the rod fit into and are held within the respective rod bores 34*b* on the second pad clamping supports 34.

To use the clip 36, a strip of abrasive paper 80 is placed over the upper side of the sanding pad 28 with the ends of the paper folded inwardly and under the pad 28 as best shown in FIG. 6. The paper is rigidly held in place by inserting the concave detent 28*a* on one end of the sanding pad into the corresponding convex detents 32*a* of the first clamping supports 32. The outward end of the clip 36 is then depressed to cause the inward end to raise upwardly at which time the sanding pad with the abrasive pad is set into the cradle formed by the supports 32, 34. Once set, the clip is released to allow the clips inward lateral edge 36*b* to move into the pads lateral concave detent 28*a*.

The shroud 30 also includes a set of rigid pad side supports 38 that extend inwardly from each side of the shroud or as shown in FIGS. 6 and 7. The supports conform to the side shape of the sanding pad 28 to provide lateral support.

The combination of the first and second pad clamping supports 32, 34 and the pad side supports 38 allow the sanding pad to extend above the edges of the shrouds peripheral opening 30*a* and provide an air space 30*f* between the inside walls and bottom surface of the shroud 30.

The final three elements comprising the second embodiment; the hermetic connector 24; the vacuum tube 26; and the vacuum unit 90 are identical to and have the same function as described for the preferred embodiment.

The third embodiment of the dust-confining shroud 10 as shown in FIGS. 9 through 13 is comprised of the following nine major elements: a sanding pad 40, a dust-confining shroud 46, an angled bracket 50, a Y-bracket 52, a T-section vacuum tube 54, a flexible vacuum hose 56, a vacuum tube 26, a strip of sandpaper 80 and a vacuum unit 90.

The sanding pad 40 used in the third embodiment is comprised of an upper section 42 and a lower section 44 as best shown in FIGS. 10 and 11. The upper section is also preferably constructed of a resilient material such as hard rubber and may be configured with a flat upper surface, as shown in FIG. 9 or an angular surface as shown in FIG. 11. The upper section 42 has within its body, a set of threaded bores 42*a* that commence from its bottom and end approximately one-half the depth of the section.

The lower section 44 has a top contour that conforms to the bottom contour of the upper section 42. The bottom section also has a set of bolt bores 44*a* that are in concentric alignment with the respective threaded bores 42*a*. The bottom surface of the lower section 44 is contoured to fit into the shape of the shrouds bottom surface as shown in FIG. 10.

In this third embodiment, the sandpaper 80 is placed over the upper surface with its ends folded inwardly and under the upper section 42. When the upper section 42 and lower section 44 are tightened, as described infra, the sandpaper is rigidly held in place.

The dust confining shroud 46 used in the third embodiment is shown generically in FIG. 9, in a first design in FIG. 10 and in a second design in FIGS. 11 and 12. In either design, the shroud is preferably constructed of an identical transparent material as described for the first embodiment.

The shroud 46, as shown in FIG. 10, has a peripheral opening 46*a* in its upper side and a vacuum port 46*b* on one of its ends that includes a vacuum hose attachment means 46*c*. On the bottom surface of the shroud is located a set of bolt bores 46*d* that are in concentric alignment with the bolt bores 44*a* located on the lower section of the sanding pad 40.

To attach the sanding pad 40 to the shroud 46 a threaded bolt 48 is initially inserted into a bore in the horizontal side 50*a* of an angled bracket 50. A second bolt 48 is likewise inserted. The two bolts are inserted into there respective bolt bores 46*d* and 44*a* on the bottom surface of the shroud and bottom section of the sanding pad 40 respectively. The two bolts are then inserted into their threaded bores 42*a* in the upper section of the sanding pad and tightened. Thus holding the sanding pad 40 with its captive sandpaper 80 rigidly held within the shroud.

After the angled brackets 50 are tightened with the bore on the vertical ends longitudinally aligned a Y-bracket 52 is swivelly attached to the angled brackets by means of a bolt and wingnut combination 52*e*. The Y-bracket, as best shown in FIG. 10, has on its lower joined end 52*a* a cylindrical opening 52*b* and on each outer end 52*c* a bore 52*d* that allows the Y-bracket to be attached to the angled brackets 50 as previously described.

The Y-bracket is attached to a T-section vacuum tube 54. This tube has an upper opening 54*a*, a lower opening 54*b* an a side opening 54*c*. The upper opening 54*a* has an attaching means that allows attachment to the cylindrical opening 54*g* This attachment means may consist of a press fit or the cylindrical opening 52*b* may be threaded to allow a compatibly threaded upper opening 54*a* to be inserted.

Between the side opening 54*c* and the vacuum port 46*b* on the shroud 40 is hermetically attached a flexible vacuum hose 56. The hose has a first attachment means 56*a* that allowsthe hose to be attached to the vacuum port 46*b* and a second attachment means that allows attachment to the side opening 54*c* The attachment means are well known in the art and are therefore not described.

The third embodiment includes a cross member bracket 50 that allows the swivelling plane of the sander 10 to be displaced by 90-degrees. The bracket consists of a U-bracket attaching member 58*a* and a shroud attaching member 58*d*. The member 58*a* has ends 58*b* that bend downwardly at 90-degrees with each end having a bore 58*c* of equal diameter to the bore on the outer end 52*c* of the Y-bracket 52. The member 58*d* has a set of bores 58*e*that are in concentric alignment with the bolt bores 46*d* on the bottom of the shroud 46. To use the bracket 58 the angled bracket 50 is removed and in its place is simply attached the bracket 58. After the member 58*d* is attached, the Y-bracket 54 is swivally attached by means of the bolt and wingnut combination 52*e*.

The second design of the shroud 46, as shown in FIG. 11, differs from the first design in that it includes a set of pad side supports 60 that extend inwardly, a vacuum port 46*a* that is centrally located on its bottom surface, and an attachment bore 62 on each side of the shroud 46.

The pad side supports 60 allow the bottom section of the sanding pad to rest on the supports. Thus allowing an air space 46*e* to exist between the bottom the shroud and the bottom of the sanding pad. As in the second embodiment there would be two side supports on each side of the shroud to insure a stable seating of the sanding pad.

As shown in FIG. 11, the bottom section 44 includes a threaded bore 44*b* that allows the threaded bolt 48 to hold both section together. Alternatively, the angled upper section 42 may be bolted to the lower section 44 by means of a set of bolts (not shown) prior to inserting and attaching the joined sanding pad 40 to the shroud.

The attachment bores 42 allow the outer ends 52*c* of the Y-bracket 52 to be angularly attached directly to the shroud. The attachment means is accomplished by the bolt and wingnut combination 52*e*. It should be noted that in either design, the Y-bracket 52 and T-section vacuum tube 54 may be formed as an integral element.

The final two elements comprising the third embodiment are the vacuum tube 26 and the vacuum unit 90. These elements are identical to and have the same function as described for the preferred embodiment.

Figure 5:
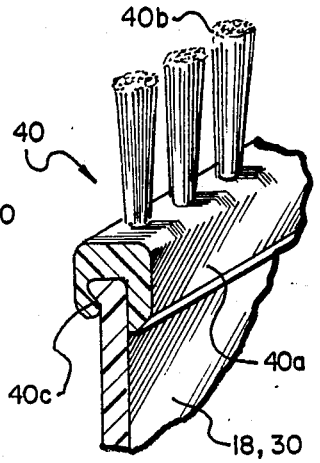
FIG. 5 is a cross-sectional view of the flexible brush assembly that may be attached to the shroud.

Common to both the first second, and third embodiments is an optional flexible bristle skirt 40. The skirt, as shown in FIG. 5, is comprised of a mounting strip 40*a* that captively holds a set of bristles 40*b* that are embedded and dispersed along the outer surface of the strip. The lower strip surface has a mounting channel 40*c* that is configured and sized to grip the peripheral edge of the shroud 18, 30. The skirt may be designed to completely encircle the shroud edge or sections of skirt may be selectively placed along the edge.

In the preferred design the bristles 40*b* extend from 0.25 inches (6.4 mm) to 0.5 inches (12.7 mm) from the strip surface. When the sander is turned on and suction is applied to the shroud, the bristles 40*b* serve to confine the dust within the shroud. The strip also can loosen dust that clings to the work surface so that such dust may enter the shroud and be exhausted through the vacuum tube into the vacuum unit 90.

While the invention has been described in complete detail and pictorially shown in the accompanying drawings it is not to be limited to such details, since many changes and modifications may be in the invention without departing from the spirit and the scope thereof. Hence, it is described to cover any and all modifications and forms which may come within the language and scope of the appended claims.

I claim:

1. A dust-confining, vacuum sander comprising:

(a) a sanding pad having means to retain on its upper side a strip of abrasive paper, (b) a dust confining shroud having a peripheral opening on its upper side and having on its lower surface a vacuum port with a contiguous, outwardly extending threaded nozzle with said shroud further having a supporting means for said sanding pad where said supporting means allows the upper side of said pad to extend above the edge of the peripheral opening and provides an air space between the inside walls and bottom surface of said shroud, (c) a hermetic connector having internal threads thar allow said connector to be threaded into said threaded nozzle, and also having a captive rotatable/angled vacuum nozzle, (d) a vacuum unit, and (e) a vacuum attachment means that allows said angled vacuum nozzle to hermetically communicate with said vacuum unit.

2. A dust-confining vacuum sander comprising:

(a) a sanding pad further comprising:

(1) an upper section having a flat upper surface and embedded within its body a rigid threaded rod that extends out the bottom surface, (2) a lower section having a top contour that conforms to and is juxtaposed against the bottom contour of said upper section and also having a rod bore therethrough in concentric alignment with the threaded rod and a lateral convex detent/pad groove on each end, (3) a strip of abrasive paper placed over the upper surface of said upper section with the ends of said paper folded inwardly and under said upper section such that when said upper section is tightened against said lower section, by means of a nut inserted into the threaded rod extending through the rod bore, said abrasive paper is rigidly held in place, (b) a dust-confining shroud having a peripheral opening on its upper side and a vacuum port on its lower surface with said shroud further comprising:

(1) a threaded nozzle contiguous with and extending outwardly from said vacuum port, (2) a rigid pad clamping support extending inwardly from each end of said shroud where said supports conform to the end shape of said lower section and with each support having a convex detent in alignment with the corresponding concave detent on said lower section, (3) a set of rigid pad side supports extending inwardly from each side of said shroud where said supports conform to the side shape of said lower section and provide lateral support to said lower section and where the combination of said pad clamping supports and said pad side supports allow the upper side of said sanding pad to extend above the edge of the peripheral opening and provide an air space between the inside walls and bottom surface of said shroud, (c) a hermetic connector having internal threads that allow said connector to be threaded into said threaded nozzle, and having a captive rotatable-/angled vacuum nozzle, (d) a vacuum unit, and (e) a vacuum tube having means on one end to be hermetically attached to said angled vacuum nozzle and on other end to said vacuum unit.

3. A dust-confining vacuum sander comprising:

(a) a sanding pad having a flat upper surface and a lateral concave detent on each end, (b) a dust-confining shroud having a peripheral opening on its upper side and a vacuum port on its lower surface with said shroud further comprising:

(1) a threaded nozzle contiguous with and extending outwardly from said vacuum port, (2) a set of rigid first pad clamping supports extending inwardly from shroud first end where said supports conform to the end shape of said sanding pad and with each support having a convex detent in alignment with the corresponding concave detent on said sanding pad, (3) a set of rigid second pad clamping supports extending inwardly from shroud second end where said supports conform to the end shape of said sanding pad and with each support having near its top edge a rod bore extending laterally therethrough, and a convex detent in alignment with the corresponding concave detent on said sanding pad, (4) a V-shaped spring clip having a slot on each inward end configured to allow said clip to move vertically along the respective edges of said second pad clamping supports where inward lateral edge of said clip is shaped to fit into the lateral concave detent on said sanding pad when said clip is in its neutral-holding position, with said clip further having a lateral rod bore on each end into which is inserted a spring-biased pivot rod where the inward ends of the rod fit into and are held within the respective rod bores on said second pad clamping supports, (5) a set of rigid pad side supports extending inwardly from each side of said shroud where said supports conform to the side shape of said sanding pad to provide lateral support, and where the combination of said first and second pad clamping supports and said pad side supports allow the upper side of said sanding pad to extend above the edge of the peripheral opening and provide an air space between the inside walls and bottom surface of said shroud, (c) a strip of abrasive paper placed over the upper side of said sanding pad with the ends of said paper folded inwardly and under said pad where said paper is rigidly held in place when the concave detent on one end of said sanding pad is inserted into the corresponding convex detents on said first pad clamping supports and the concave detent on the other side of said pad is inserted into the inward edge of said spring clip, (d) a hermetic connector having internal threads that allow said connector to be threaded into said threaded nozzle, and having a captive rotatable-/angled vacuum nozzle, (e) a vacuum unit, and (f) a vacuum tube having means on one end to be hermetically attached to said angled vacuum nozzle and on other end to said vacuum unit.

4. A dust confining vacuum sander comprising:

(a) a sanding pad further comprising:

(1) an upper section having a flat upper surface and having within its body a set of threaded bores that commence from the bottom surface, (2) a lower section having a top contour that conforms to and is juxtaposed against the bottom contour of said upper section and also having a set of bolt bores in concentric alignment with said set of threaded bores, (3) a strip of abrasive paper placed over the upper surface of said upper section with the ends of said paper folded inwardly and under said upper section such that when said upper section is tightened against said lower section, said abrasive paper is rigidly held in place, (b) a dust confining shroud having a peripheral opening on its upper side, a vacuum port on one end with a set of bolt bores in concentric alignment with said bolt bores on the lower section of said sanding pad, (c) a set of angled brackets having a vertical side and a horizontal side with each side having a bore therethrough, (d) a Y-bracket having on its lower joined end a cylindrical opening and on each outer end a bore therethrough that allows each outer end to be swivelly attached by an attachment means to the vertical side of each of said angled brackets, where each horizontal side of said angled bracket is attached to the bottom surfaces of said shroud by inserting a threaded bolt through the bracket and into the set of bores of said shroud and the lower section of said sanding pad and into the threaded bores on the upper section of said sanding pad where when said bolts are tightened, the angled bracket, said shroud and the two sections of the sanding pad, with the abrasive paper therebetween, are rigidly held in place, (e) a T-section vacuum tube having an upper opening, a lower opening and a side opening, with upper opening having a means to be attached to the cylindrical opening on said Y-bracket, (f) a flexible vacuum hose having a first attachment means on one end to allow attachment to the vacuum port on said shroud and having a second attachment means on the other end to allow attachment to the side opening on said T-section, (g) a vacuum unit, and (h) a vacuum tube having means on one end to be hermetically attached to lower opening on said T-section and on the other end to said vacuum unit.

5. The dust confining vacuum sander as specified in claim 4 further comprises a cross-member bracket consisting of a Y-bracket attaching member with ends that bend downwardly and with each end having a bore therethrough, and a shroud attaching member rigidly and centrally attached to said Y-bracket attaching member with the shroud attaching member having a set of bores that are in concentric alignment with the bores on said bottom surface of said shroud where said cross member bracket allows the swivelling plane of the sander to be displaced by 90-degrees.

6. The dust confining shroud as specified in claim 4 wherein said shroud has a set of pads side supports extending inwardly and shaped to allow the bottom section of said sanding pad to rest on top of said supports to thus allow an air space to exist between the bottom of said shroud and bottom of said sanding pad with said shroud also having said vacuum port centrally located on its bottom surface and also having on each side of said shroud an attachment bore therethrough to where is angularly attached the outer ends of said Y-bracket by an attached means.

7. The sander as specified in claims 1, 2, 3 or 4 where said vacuum unit is comprised of a vacuum cleaner.

8. The sander as specified in claim 2 wherein said pad clamping supports and said pad side supports are made integral with said dust confining shroud.

9. The sander as specified in claim 3 wherein said first pad clamping supports, second pad clamping supports and pad side supports are made integral with said dust confining shroud.

10. The sander as specified in claims 1 or 2 wherein said sanding pad is made of a resilient material.

11. The sander as specified in claims 3 or 4 wherein the upper section of said sanding pad is made of a resilient material.

12. The sander as specified in claims 1, 2, 3 or 4 wherein the work contacting upper surface of said sanding block is either flat or angular.

13. The sander as specified in claims 1, 2 or 3 further comprising a flexible bristle section consisting of a mounting strip captively holding a set of bristles embedded and dispersed along the outer surface of the strip with the lower strip surface having a mounting channel that is configured and sized to grip the peripheral edge of said shroud.

* * * * *